United States Patent [19]

Charbonneau et al.

[11] 4,306,496

[45] Dec. 22, 1981

[54] AUTOMATICALLY CONTROLLED NUMBERING MACHINE

[76] Inventors: Jean Jacques Charbonneau, 109A Lepage St., Ste-Anne des Plaines, Quebec, Canada, J0N 1H0; Christian Tailleux, 7280 Toulon St., Brossard, Quebec, Canada, J4W 1X1

[21] Appl. No.: 155,143

[22] Filed: May 30, 1980

[51] Int. Cl.[3] ..... B41L 45/00

[52] U.S. Cl. ..... 101/76; 101/77; 101/247

[58] Field of Search ..... 101/70, 72, 76, 77, 101/84, 85, 86, 87, 247

[56] References Cited

U.S. PATENT DOCUMENTS

| | | | |
|---|---|---|---|
| 3,782,277 | 1/1974 | Neal | 101/76 |
| 3,985,073 | 10/1976 | Keller | 101/247 X |
| 4,044,666 | 8/1977 | Dovcet | 101/76 |
| 4,068,582 | 1/1978 | Poitons et al. | 101/247 X |
| 4,085,670 | 4/1978 | Poole | 101/76 |
| 4,248,145 | 2/1981 | Patyk et al. | 101/77 |
| 4,262,590 | 4/1981 | Bouckner | 101/76 |

*Primary Examiner*—Edward M. Coven

[57] ABSTRACT

A numbering assembly is disclosed, which is incorporated into a conventional press of the offset type and may selectively be rendered inoperative if numbering is not desired or printing is stopped, or automatically deactuated during the operation of the offset press if no printed material is discharged to avoid movement or change of numbers on the register in the absence of printed material on which a number is to be printed. The numbering assembly according to the invention comprises an improved control assembly including a first electrical circuit comprising a detection device responsive to the presence and absence of gripped material, a first normally open switch and a solenoid connected in series. The control assembly also includes a second electrical circuit which comprises a main switch, a relay connected to the first circuit in parallel to the solenoid, and the said solenoid, all connected in series. When actuated, the solenoid operates mechanical means which brings the numbering machine in operative position so that the number to be impressed be stepped each time a sheet of printed material is passing through the numbering machine.

6 Claims, 7 Drawing Figures

AUTOMATICALLY CONTROLLED NUMBERING MACHINE

The present invention relates to an improved automatically controlled numbering machine for use in a conventional printing press of the offset type.

Numbering machines used for serially number a run of consecutive records such as bills, checks, tickets and the like, fed at high speed past a printing position, are well known in the art of printing. Each of these machines comprises a printing register mounted on a rotatable shaft, which is stepped one unit forward at each printing operation. Generally, the stepping takes place under control of a fixed stop which acts during each revolution of the shaft to cam a pawl which in turn steps forward the register.

As is well known by those skilled in this art, a numbering machine can be considered as being efficient when used in a high speed cylinder press only if its satisfies the following specific requirements.

First of all, it is necessary that the numbering machine be instantaneously deactuated upon stopping of the press to avoid the register from being stepped several units forward, and any further printing operation from being effected due to the residual inertia of the register shaft.

Secondly, it is necessary that the numbering machine be instantaneously deactuated if the press is in operation but the material to be printed has been exhausted.

Thirdly, it is necessary that the numbering machine be automatically reactuated after having been deactuated during the operation of the press, when printed material is supplied again.

A numbering assembly including a numbering machine and a control assembly therefor and satisfying all the above requirements, has already been invented and forms the subject matter of U.S. Pat. No. 4,068,582 issued on Jan. 17, 1978 in the name of Equipment Precibec Inc.

The numbering assembly disclosed in this patent is incorporated into a conventional press of the offset type. The numbering machine may selectively be rendered inoperative if numbering is not desired or printing is stopped,. and is automatically deactuated during the operation of the press if no printed material is discharged to avoid movement or change of numbers on the register in the absence of printed material on which a number is to be printed.

The machine is also automatically reactuated after having been deactuated during the operation of the press, when printed material is supplied again.

Structurally, this numbering assembly comprises an improved control assembly in addition to the numbering machine, which assembly includes three interconnected electrical circuits acting together to perform the above mentioned operations.

The first electrical circuit comprises detection means responsive to the presence and absence of printed material, a first normally open switch and a relay connected in series. The second electrical circuit comprises a main switch, the above-mentioned relay and a first solenoid connected in series. This first solenoid operates first mechanical means which in turn closes a third electrical circuit which comprises a switch operated by the first mechanical means, the main switch and a second solenoid. The second solenoid operates second mechanical means which brings the numbering machine in operative position so that the number to be printed be stepped forward each time a sheet of printed material is passing through the numbering machine.

When one or several sheets of printed material are missing, the detection means opens the first electrical circuit which in turn opens the second electrical circuit through the relay. The first solenoid being deactuated, the first mechanical means are released and the third electrical circuit is opened. The second solenoid being thus deactuated, the second mechanical means are released and move the stop out of the path of the stepping paw of the register. The duration of the whole deactuating operation is predetermined so that the numbering machine be deactuated only after the last sheet of paper has been printed by the register and the latter has been stepped one unit forward in view of consecutively numbering the first sheet of paper to be subsequently supplied into the machine.

The above described numbering assembly forming the subject matter of U.S. Pat. No. 4,068,582 has proved to be particularly efficient in practise not only because it meets all the above recited requirements, but also because its structure is quite simple and does not need extensive mechanical and/or electronical adjustment.

It has now been found that the structure of the numbering assembly disclosed in U.S. Pat. No. 4,068,582 could further be simplified. More especially, it has been found that all the requirements recited above could be met with a numbering assembly comprising a control circuit including two interconnected electrical circuits only, instead of three, and substantially less mechanical elements.

The object of the present invention is therefore to provide an improved numbering assembly incorporated into a conventional offset press, which fully satisfies all the characteristics of operation required from a numbering machine to be efficient in practise while being much simpler in conconstruction than any of the already known machines.

In accordance with the present invention, this object is achieved with an improved, automatically controlled numbering machine forming part a numbering assembly incorporated into a conventional offset press of the type including a printing machine and a delivery machine cooperatively arranged relative to the printing machine for receiving the printed material discharged therefrom and delivering it to a point of deposit this delivery machine including driving means and picking-up devices associated to these driving means for gripping and pulling forward the material discharged from the printing machine.

In addition to the numbering machine which is mounted on a shaft suitably positioned with respect to the delivery machine to serially number the printed material passing therethrough, the numbering assembly comprises an impression roller positioned beneath the numbering machine in cooperative relationship therewith.

As in the already known numbering machines, the numbering machine according to the invention includes printing wheels having serial numbers thereon, a pawl for selectively stepping the printing wheels each time a number is to be impressed upon a sheet of printed material and a stop for actuating the pawl at each passage of a sheet of printed material. However, as compared to the already known machines, the numbering machine according to the present invention is associated to an improved control assembly which is much simpler in construction as that already known and disclosed in U.S. Pat. No. 4,068,582.

This improved control assembly includes a first electrical circuit comprising a detection device responsive to the presence and absence of gripped material into the delivery machine, a first, normally open switch, and a solenoid connected in series. The first circuit also comprises a relay mounted in parallel to the solenoid. The detection device closes the first circuit when printed material is normally supplied and opens the same when printed material is missing. The first switch closes the first circuit for a short period of time at each rotation of the shaft on which is mounted the numbering machine. The relay closes a second electrical circuit for a predetermined period of time each time it receives an electric impulsion from the first switch. The latter also actuates the solenoid which in turn actuates mechanical means which brings the stop of the numbering machine in operative position into the path of the pawl so that the number to be printed be stepped each time a sheet of printed material passes through the numbering machine.

In order to keep the solenoid in actuating position even when the first switch is not closed by the rotation of the shaft, the improved control assembly according to the invention also includes the second electrical circuit which comprises a second, normally closed switch, the above mentioned relay and the above mentioned solenoid.

As aforesaid, the relay when actuated, closes the second electrical circuit for a predetermined period of time which corresponds to the time necessary for the shaft to complete a rotation and close again the first switch of the first circuit. During the predetermined period of time, the second electrical circuit is therefore closed and the solenoid is kept in actuating position.

When one or several sheets of printed material to be numbered are missing, the detection device opens the first electrical circuit which, in turn, opens the second electrical circuit through the relay. The solenoid is then deactuated and thus releases the mechanical means which moves the stop out of the path of the stepping pawl with a small delay after both circuits have been completely switched off.

Owing to the second electrical circuit which keeps the solenoid in actuating position during one additional rotation of the shaft even when the first electrical circuit has been opened and to the structure mechanical means which gives another extension of time to the whole assembly before moving the stop out in inoperative position, the numbering machine is automatically stepped one unit forward after the last sheet of printed material has passed through it and has been numbered, this allowing printing of the number serially following the last printed number, onto the first sheet of printed material that is subsequently supplied into the machine, without having to adjust the wheels of the numbering machine.

Or course, the detecting device is so located inside the numbering machine that the whole deactuation cycle is completed only after the passage of the last sheet of material in front the printing register.

As aforesaid, the numbering assembly comprises an impression roller positioned beneath the numbering machine in cooperative relationship therewith. This impression roller is mechanically connected to and actuated by the mechanical means which forms part of the control assembly, and comprises a main lever which is mounted on a central pivot and permanently provided with an oscillary movement generated by a pull-back spring and a main cam mounted on the numbering machine shaft.

The mechanical means also comprises a stop lever that is also operated by the solenoid and supports the stop used for camming the pawl of the numbering machine on its axis.

The mechanical means further comprises blocking means operated by the solenoid for limiting the amplitude of the oscillations of the main lever, and first and second blocking levers for holding both ends of the stop lever on which is mounted the stop when the latter is in operative position. The first blocking lever is permanently provided with an oscillary movement generated by a pull back spring and another cam also mounted on the numbering machine shaft at an angle with respect to the main cam, to give the above mentioned delay to the stop before being moved out while the second blocking lever is connected to the main lever and actuated by it when the oscillations of this main lever are not limited by the blocking means.

As long as either the first or second electrical circuits are closed, the solenoid is actuated and causes both the stop lever to be tilted about its axis and to hold the stop in operative position and the blocking means to limit the oscillations of the main lever. Tilting of the stop lever is delayed when the circuits are closed by the first blocking lever which releases the stop lever only when the other cam moves the first blocking lever up. The second blocking lever is positioned inside the machine in such a manner that it may engage the stop lever when the same is tilted in operative position and hold it in this position even when the first blocking lever is released by the other cam at each rotation of the machine shaft.

As soon as the solenoid is deactuated, the blocking means limting the oscillation of the main lever are first released. This allows the main lever to actuate the second blocking lever which releases the stop lever. The latter then may return into a non-operative position owing to a pull-back spring fixed to the solenoid as soon as it is finally and completely released by the first blocking lever when the latter is actuated by the other cam.

In accordance with a preferred embodiment of the invention, the numbering assembly includes an inking device for inking the register. This inking device may be manually operated or mechanically connected to and actuated by the shaft of the numbering machine, in any conventional manner.

The invention and its advantages will be better understood with reference to the following non-restrictive description of a specific embodiment thereof, taken in connection with the accompanying drawings in which.

The automatically controlled numbering machine that will be hereinafter described in detail, is part of a conventional offset press including a printing machine and a delivery machine. The structures of the offset press, the printing machine and the delivery machine are already known and will not be described further than necessary to the understanding of the invention, as no invention per se is claimed therefor.

In the offset press, the automatically controlled numbering machine is cooperatively arranged relative to the delivery machine which receives the printed material discharged from one end of the printing machine, and delivers it to a point of deposit.

This arrangement is well known in this field as can be seen from U.S. Pat. No. 4,068,582 already referred to in the present disclosure. Nevertheless, a brief description of this conventional arrangement will now be given to help in better understanding the invention.

Figure 1:
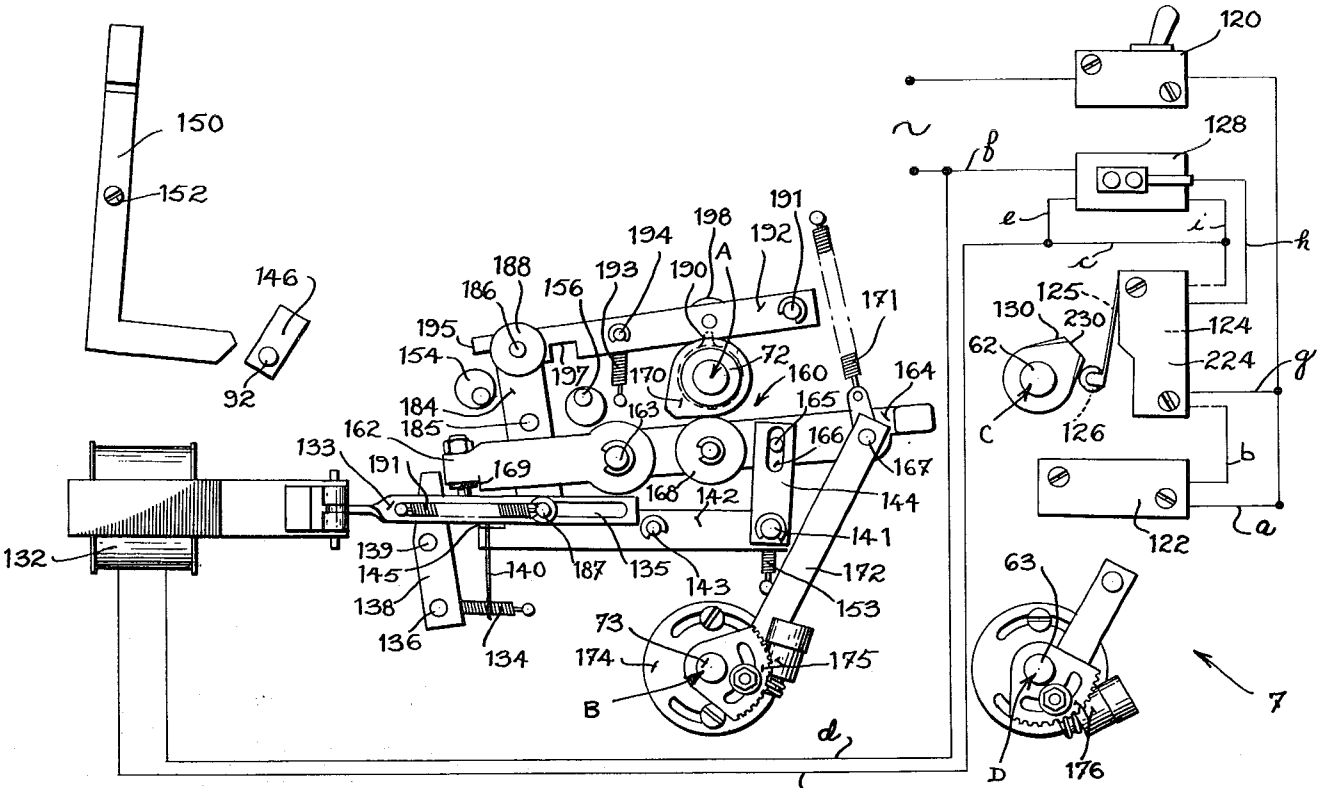
FIG. 1 is a plan view of the control assembly of an automatically controlled numbering machine according to the invention, in non-operative position.
Figure 2:
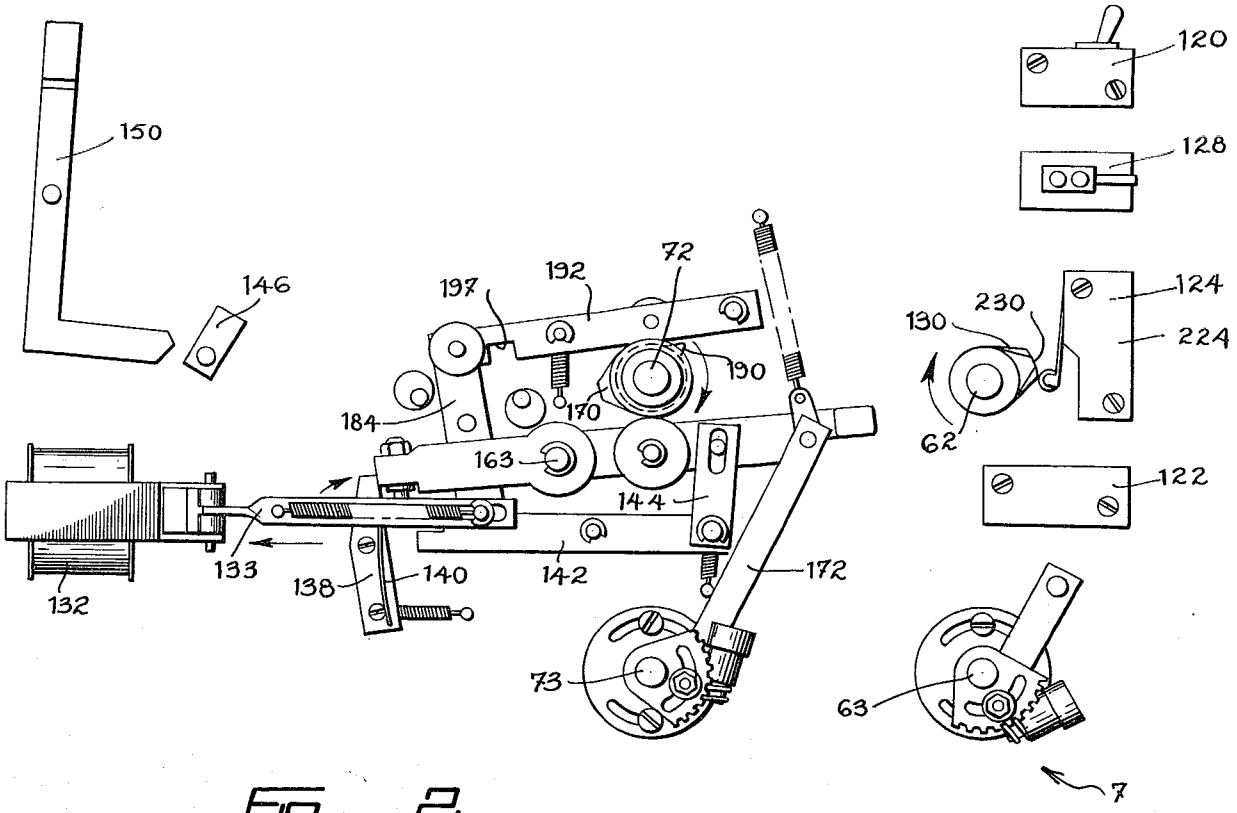
FIGS. 2 and 3 are evolutive plan views of the control assembly shown in FIG. 1, when a sheet of printed material is supplied into the numbering machine.
Figure 3:
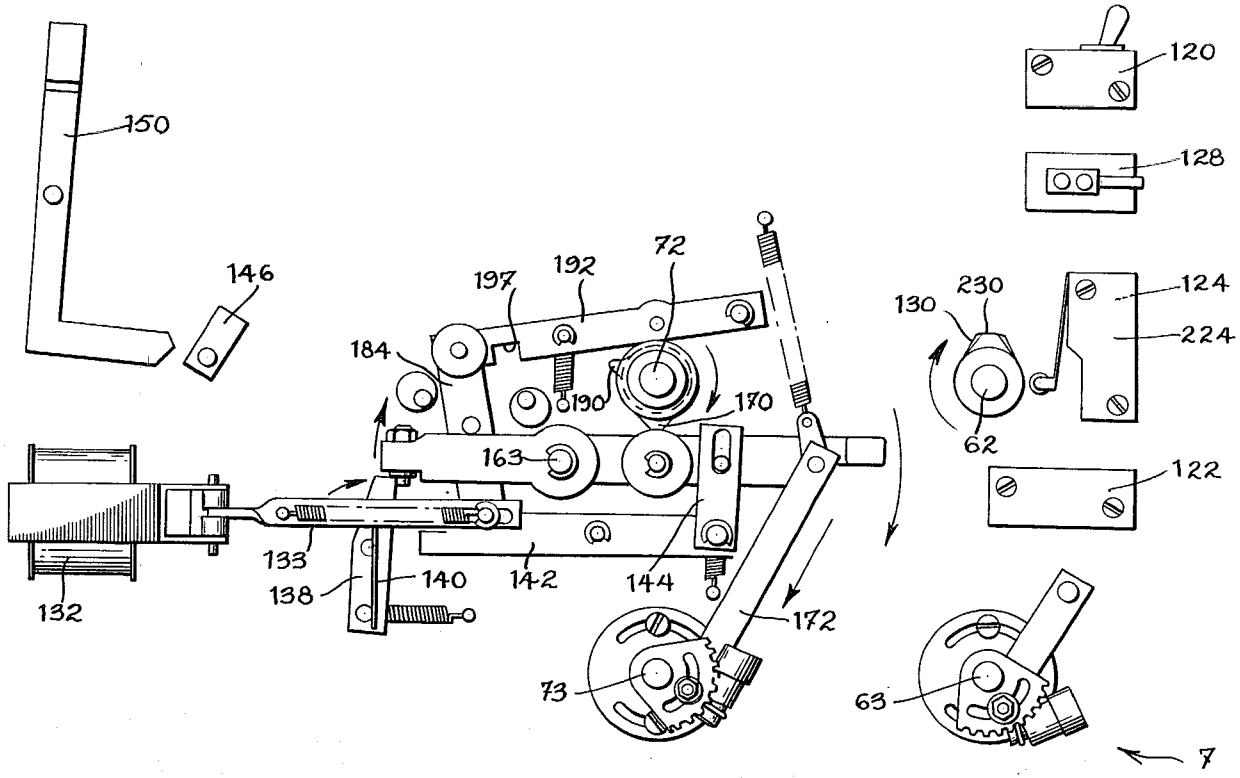
Figure 4:
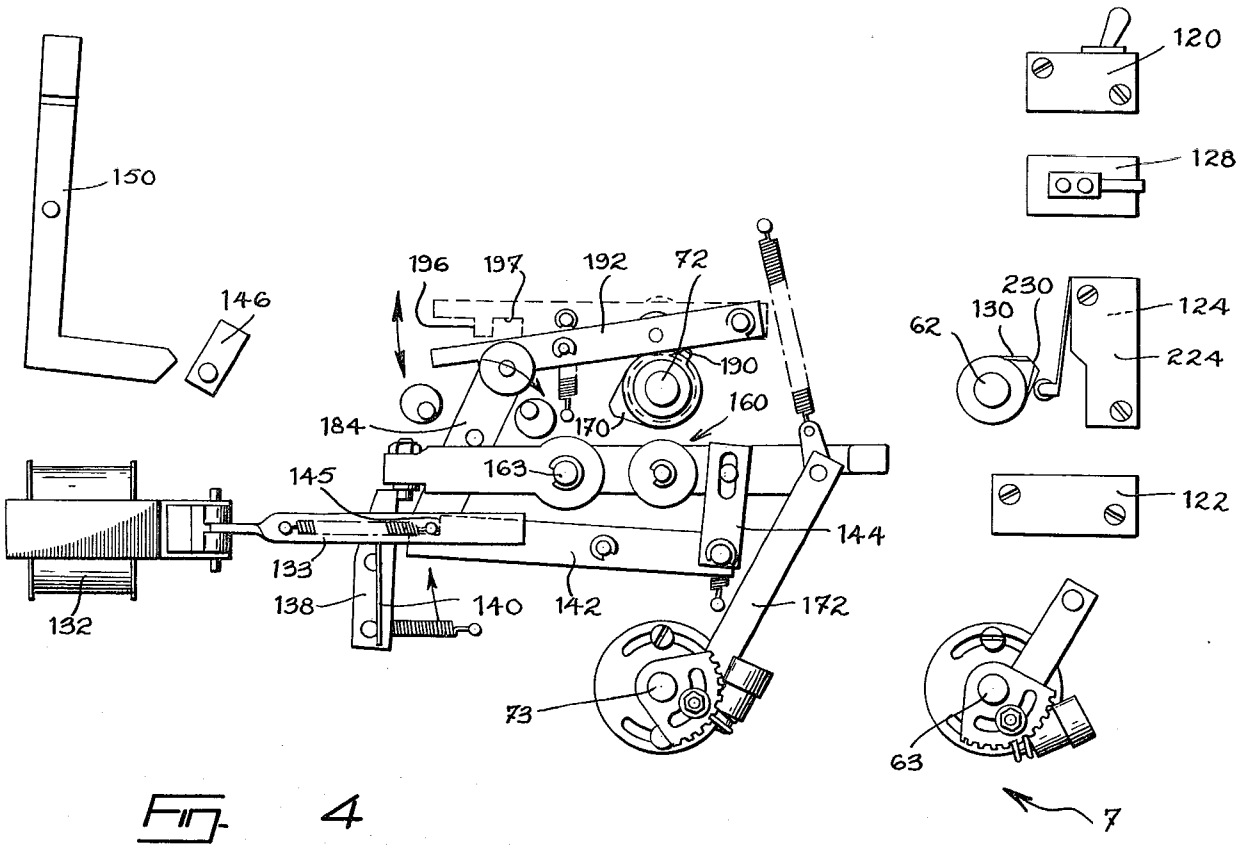
FIG. 4 is a plan view of the control assembly shown in FIG. 1, in operative position.
Figure 5:
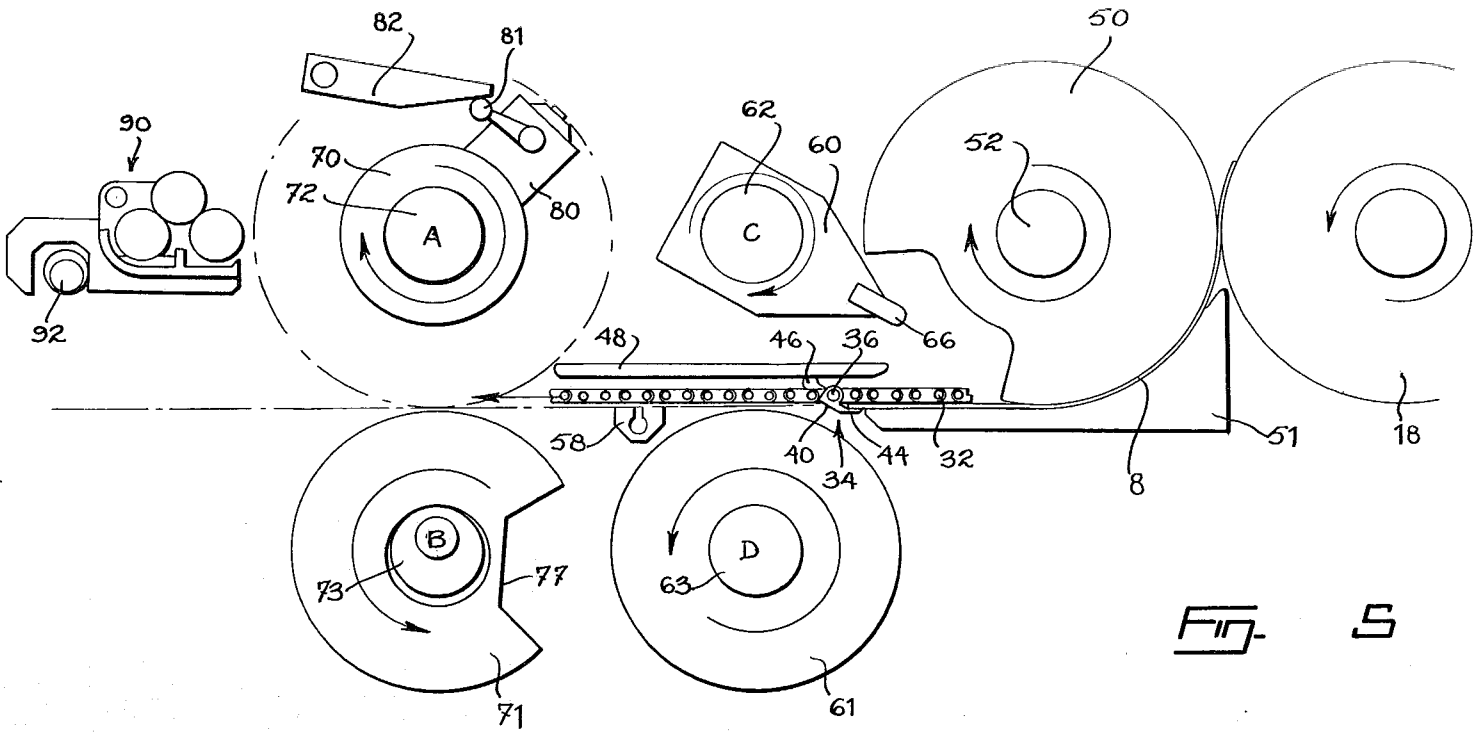
FIGS. 5 and 6 are schematic views showing the material picking up system of the delivery machine and the printing assembly of the numbering machine in two different working positions.
Figure 6:
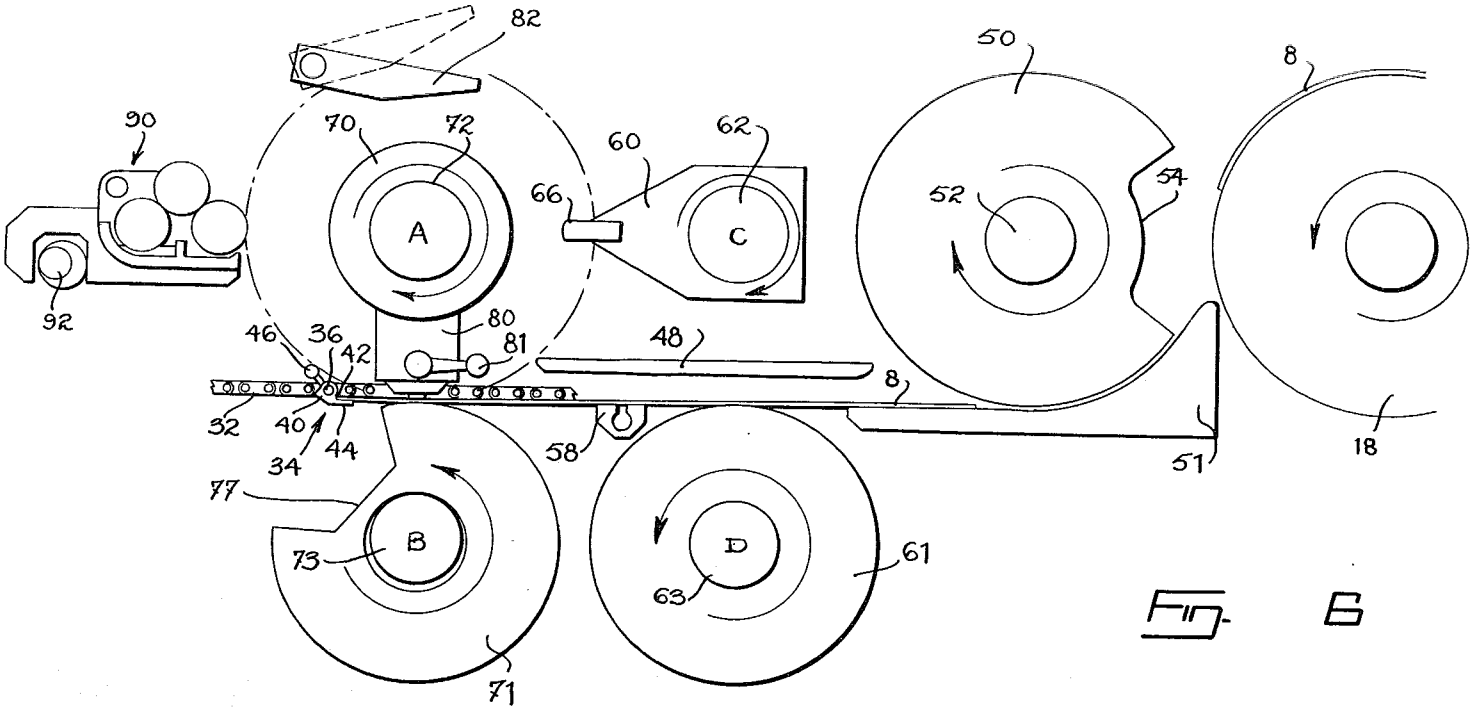

Referring to FIGS. 5 and 6 of the drawings, the delivery machine includes a pair of chains 32 driven by a conventional driving mechanism (not shown) operatively connected to the press assembly motor in a well known manner. A plurality of material picking up devices 34 of a conventional type are connected to the chains 32 in a predetermined spaced-apart relationship. This predetermined relationship is selected in such a manner that a picking-up device 34 is positioned to receive and grip the printed material each time a sheet 8 thereof is discharged from the last roller 18 of the printing machine. The sheets 8 of printed material are then carried by the devices 34 to the point of deposit (not shown) where they are stacked and aligned with respect to each other in a receiving tray.

Each picking-up device 34 includes a shaft 36 extending between the chains 32 across the machine, and at least one gripping device 40 mounted on the shaft 36 and operated by a well known cam arrangement. The gripper 40 comprises two jaws 42 and 44 between which engages the leading edge portion of the sheet 8 of printed material. The jaws 42 and 44 are respectively affixed to and rotatably journalled on the shaft 36. The outer end of the jaw 44 overlies the corresponding end of the jaw 42 and is closed upon the latter by means of a coil spring (not shown). The opening of the gripper 40 is effected by means of a camfollower 46 mounted on a level arm extending the movable jaw 44, which cooperates with a cam 48 disposed in its path in the zone where gripping is desired. Another cam is disposed in a similar manner in the zone near to the point where release of sheets 8 is desired.

Picking-up devices of the above-mentioned type are well known in this field of the art and will not be further described.

The sheets 8 of printed material are conveyed from the last roller 18 of the printing machine to the gripping zone where grippers 40 pick them up by means of a rotating wheel 50 adjacent to the roller 18. This rotating wheel 50 cooperates with a shaped deflector 51 which tangentially extends the surface of the roller 18. The wheel 50 which is mounted on a rotating shaft 52 parallel to the roller 18, is recessed on a portion 54 of its periphery to allow rotation of a pushing arm 60 mounted on a shaft 62 having an axis C parallel to that of shaft 52. The main function of this rotating arm is to push forward each sheet 8 of printed material leaving the conveying zone so that the leading edge portion thereof fully engages between the jaws 42 and 44 of the grippers 40 when the latter are in the opened position. For this purpose, a pad 66 is positioned at the end of arm 60 for tangentially pushing the sheet of printed material at each rotation of the shaft 60, and a roller 61 mounted on a shaft 63 having an axis D parallel to axis C, is positioned beneath the arm 60 and sheet 8 in cooperative relationship with the pad 65.

If desired, the pad 66 may be replaced by a perforating device which can extend transversally and/or longitudinally along an arc of circle centered about the axis C, and cooperate with the roller 61 to make transversal and/or longitudinal perforations in the sheets of printed material discharged from the printing machine. Such a perforation attachment is already known and commonly used in offset presses. However, it has apparently never been suggested to use it in the above mentioned position relative to the printing machine, with the additional function of pushing forward the sheets 8 of printed material into the grippers 40.

The sheets 8 of printed material after having been picked-up, are pulled by the picking-up devices 34 towards the point 12 where they are released and stacked. During this travel, they pass between the numbering machine 80 which is mounted on a drum 70 that in turn is mounted on a shaft 72 having an axis A, and a suitable impression roller 71 positioned beneath the numbering machine 80 in cooperation relationship therewith. The impression roller 71 is mounted on a rotating shaft 73 having an axis B, and is actuated by a conventional eccentric system associated to the shaft 73 in a known manner. This eccentric system urges upwardly the roller 71 against the numbering machine 80 at a time synchronized with the time of passage therebetween of each sheet 8 of printed material, so as to obtain a better impression.

The impression roller 71 which extends across the whole path of the sheets of printed material, is recessed on a portion 77 of its periphery to allow passage to the shafts 36 and grippers 40, being provided that the not-recessed portion of the periphery of the roller has a length substantially equal to the length of the sheets 8 of printed material.

The numbering machine 80 which is used, is of a conventional type including a well known arrangement of printing wheels having serial numbers thereon, which are selectively advanced in a known manner by means of a pawl 81 each time a number is to be impressed upon a sheet to be printed. In this regard, it is pointed out that no invention is claimed in the numbering machine 80 per se. The printing wheel advance takes place under control of a stop 82 which can be selectively positioned in the path of pawl 81 so as to cam the latter at each rotation of the drum 70.

As usual, a conventional removable inking device 90 including a plurality of rollers, is positioned in cooperative relationship with the numbering machine 80 so as to contact and to ink the same either automatically at each rotation of drum 70, or manually at selected moment. This arrangement is well known in this field of the art. Thus, for example, the inking device 90 can be automatically shifted toward the numbering machine 80 by means of a cam 92 actuated in a synchronized relationship with the time of passage in front thereof of the numbering machine 80. Such a synchronized to-and-fro shifting movement of the inking device 90 advantageously may allow any conventional perforating or multicolor impression printing device to be mounted on the shaft 72 besides the numbering machine 80 and therefore to be operated together with it.

From the above, it will be understood and appreciated that a plurality of numbering machine 80 can be mounted on the single drum 70, if desired. In this case, the operation of all of the numbering machines will be the same.

By mere rotation of the drum 70 which carries the numbering machine 80 and adjustment of the camshaft 73 on which is mounted the roller 71, it is also possible to selectively vary the location of the zone to be printed on the printed material, the travelling movement of the picking-up devices 34 carrying the sheets 8 being precisely timed to coincide with the printing phase wherein the numbering machine 80 is disposed downwardly and the roller 71 is lifted upwardly by means of the camshaft 73.

In order to ensure a still better impression of the numbers to be printed upon the sheet 8 of printed material passing between the numbering machine 80 and the roller 71, a sheet tensioning device 58 is provided before the roller 71, which consists of an opened pipe extending across the path of the sheets and through which vacuum is made.

Figure 7:
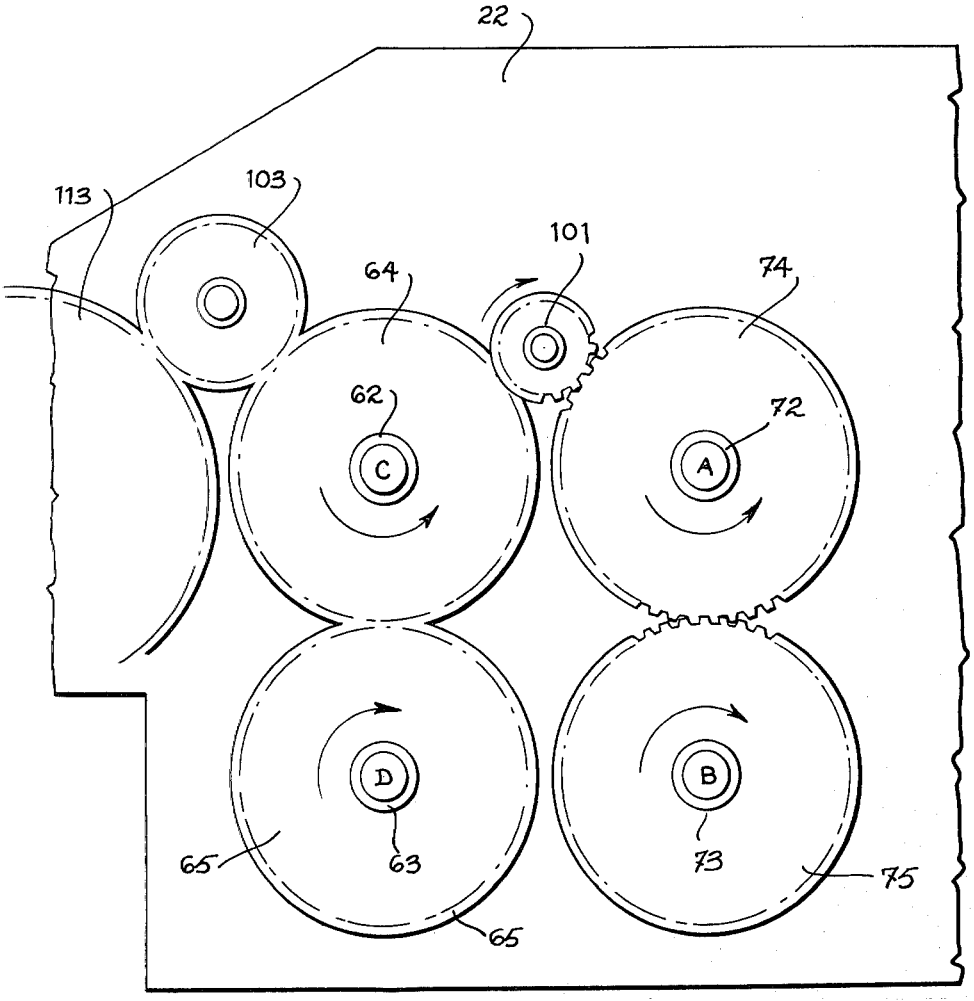
FIG. 7 is a plan view of the set of gearing wheels connecting the elements of the material picking-up system and printing assembly of the numbering machine.

The shaft 72 on which is mounted the drum 70 and the numbering machine 80, the camshaft 73 on which is mounted the impression roller 71, the shaft 62 on which is mounted the pushing arm 60 and the shaft 63 on which is mounted the roller 61, are all connected together and each rotated in the appropriate direction by means of a set of gear wheels operatively connected to the chain driving mechanism, as shown in FIG. 7, which is a plan view of a portion of one of the outer walls 22 of the delivery machine.

As the view is taken from the outside of the machine, it will be seen that the respective position of the axes A, B, C and D is inversed as compared to FIGS. 5 and 6.

The shafts 62, 63, 72 and 73 extending across the delivery machine 3 are respectively fixed to four gear wheels 74, 64, 65 and 75 located outside wall 22. All of these wheels have the same diameter and pitch so as to rotate at a same speed synchronized with the travelling movement of the picking-up devices 34. Gear wheels 74 and 75 and gear wheels 64 and 65 are respectively in gear contact with each other, while gear wheels 64 and 74 are connected with each other by means of a transmission gear 101. The whole set of gear wheels is connected in a known manner (not shown) to the chain driving means by means of a set of gear wheels 103 and 113. It can be seen that, in operation, gear wheels 64 and 74 driving shafts 62 and 72 respectively, are both rotated in the same direction and that gear wheels 65 and 75 which drive shafts 63 and 73 respectively are both rotated in the opposite direction, as indicated by arrows in FIGS. 5, 6 and 7.

As indicated in the preamble of the present disclosure, the numbering machine 80 and the impression roller 72 cooperating therewith are both associated with an improved control assembly 7 shown in detail on FIGS. 1 to 4.

This improved control assembly 7 is used for selectively rendering inoperative the numbering machine 80 when numbering is not desired or printing is stopped, for automatically deactuating the same during the operation of the offset press 1 if no printed material is discharged and for automatically reactuating the same when printed material is supplied again, to ensure a proper chronology of numbers on consectuve records without having to reset the numbering machine prior to each operation thereof.

In order to perform these functions, the control assembly 7 is coupled to the stop 82 used to cam the actuating pawl 81 of the numbering machine 80. If no printed material on which a number is to be printed is discharged from the offset press and conveyed by the delivery machine, the control assembly 7 automatically moves the stop 82 out of the path of the pawl 81 and thus avoids the printing wheels of the numbering machine 80 to be advanced at each revolution of the shaft 72. When printed material is discharged again from the offset press, the control assembly 7 automatically moves the stop 82 back in the path of the pawl 81, which resumes stepping of the printing wheels of the numbering machine.

By means of the control assembly 7, the stop 82 may also be selectively moved out of or in the path of the pawl 81 to allow the press to be stopped without any further printing operation being effected due to the residual inertia of the shaft 72 or to allow the press to keep on running when numbering is not required or desired, such as for example when a test run of a few sheets or printed material on which numerals are not desired, is requested to adjust the offset press.

Referring to FIGS. 1 to 4 the control assembly 7 includes a detection device 122 responsive to the absence of printed material in the offset press. This detection device 122 consists in a mechanically operated sensor disposed in the path of the sheets of printed material, which operates a delay switch forming part of the sensor. This delay switch switches on a first electrical circuit for a predetermined period of time, each time a sheet 8 of printed material passes in contact therewith. The predetermined period of time during which the electrical current is allowed to flow through the first circuit by the delay switch is selected in such a manner that the first circuit is permanently switched on when printed material is normally supplied in the press and is switched off in the other case, such as, for example, when one or several sheets of printed material are missing.

Instead of a mechanical sensor working in combination with a delay switch, use could be made of a time delayed photoelectric cell or of any other device having the same function.

The first electrical circuit which is permanently switched on by the detection device 122 when printed material is supplied, also comprises a switch 124 and a solenoid 132. These detection device 122, switch 124 and solenoid 132 are connected in series to a conventional electric source via a set of wires a, b, c and d. The first circuit further comprises a relay 128 mounted in parallel to the solenoid 132 via a first wire e connected to wire c, and a second wire f connected to wire d.

The switch 124 is of the normally open type and comprises a resilient metallic lamella 125 provided at its free end with a roller 126. This switch 124 is actuated by a cam 130 fixed on the shaft 62 on which is mounted the pushing arm 60. At each rotation of the shaft 62, the cam 130 moves the lamella 125 toward in a switch-on position and connects wire b to wire c.

Thus, at each rotation of the shaft 62, the cam 130 electrically actuates the solenoid 132 and the relay 128 mounted in parallel, via the switch 124, provided that the detection device 122 is switched on by the passage of sheets of printed material.

This relay 128, each time that it receives an electric impulsion from the switch 124, closes a second electric circuit for a predetermined period of time which substantially corresponds to the duration of one rotation of the shaft 62.

The second electrical circuit which is switched on for a predetermined period of time every time the first electrical circuit is completely closed, comprises a switch 224, the relay 128 and the solenoid 132. These switch 224, relay 128 and solenoid are connected in series to the electrical source via a set of wires g, h and i, the latter being connected to wire c, and d.

The switch 224 is of the normally closed type and comprises a resilient metallic lamella 225 provided at its free end with a roller 226. This switch 224 is actuated by a cam 230 fixed on the shaft 62 just beside the cam 130. At each rotation of the shaft 62, the cam 230 moves the lamella 225 toward in a switch off position and disconnects wire g from wire h.

The necessity of opening the second electrical circuit at each rotation of the shaft 62 will be fully explained hereinafter.

In addition to all the above elements, the first and second electrical circuits both comprise a main switch 120 which is of the ON-OFF type. This switch 120 permits to manually open the first and second electrical circuits and thus to selectively deactuate the numbering machine when numbering is not required or desired, even if the printing machine is kept on running.

The solenoid 132, when electrically actuated, acts on mechanical means which brings the stop 82 of the numbering machine in operative position into the path of the pawl 81.

More specifically, the solenoid 132 when actuated, pulls and holds in position a rod 133 which in turn pulls and holds in position a blocking arm 138 mounted on a fixed pivot 139, and a stop lever 184 mounted on a central shaft 185.

The stop lever 184 which is pulled and held in position together with the blocking arm 138 by the rod 133 when the solenoid 132 is actuated, supports the stop 82 which controls the advance of the printing wheels of the numbering machine 80. The stop 82 (not shown on FIGS. 1 to 4) is rigidly mounted onto the lever 184 and extends in a direction perpendicular to that of the shaft 185 in such a manner that it is positioned in the path of the pawl 81 when the lever 184 is pulled by the solenoid 132 and it moves out of the same path when the solenoid 132 is deactuated.

As can be seen on FIGS. 1 to 4, the rod 133 is connected to the stop lever 184 by a spring 191 fixed at one end to the rod 133 and at the other end to a pin 187 which is mounted at one end of the lever 184 and passes through a slot 135 extending along the rod 133. This arrangement also gives a slack to the stop lever 184 when the rod 133 is pulled by the solenoid, such a slack being necessary as will also be seen hereinafter.

As can also be seen of FIGS. 1 to 4, the oscillation movement of the stop lever about its axis 185 is laterally minimized by two adjustable stops 154 and 156 respectively located on each side of the lever 184.

The blocking arm 138 which extends in a direction substantially perpendicular to that of rod 133, is not operated directly by the rod 133. As can be seen, on the FIGS. 1 to 4, the blocking arm 138 is operated by the rod 133 via a metallic lamella 140 welded onto the rod 133, and thereby moves together with it when the solenoid 132 is operated. As can better be seen on FIGS. 2 and 3 only, the lamella 140 when pulled together with the rod 133 by solenoid, comes into contact with a pin 136 which is mounted at one end of the blocking arm 138 and pushes it in such a manner that it rotates about its pivot 139. When the solenoid 132 is deactuated, the rod 133 and the lamella 140 are moved back in a non-operative position and allow a spring 134 fixed to the pin 136 to pull back the blocking arm 138 about its pivot 139. As can be seen on FIG. 2, the lamella 140 is made of resilient steel to give a slack to the blocking arm 138, such slack being necessary as will be seen hereinafter.

As aforesaid, when the blocking arm 138 is pushed by the lamella 140, it rotates about its pivot 139 against the spring 134. This rotational movement allows the upper ends of the blocking arm 138 which is opposite the pin 136, to engage below an abutment 169 located at one end 162 of a main lever 160 mounted on a fixed central pivot 163, to block this lever 160 downwardly.

The other end 164 of the lever 160 is connected to a cam-actuating device 174 of a known type, by a link 172 mounted onto a pin 167 extending its other end 164. This cam-actuating device 174 is part of the eccentric system acting on the shaft 73 of the impression roller 71 to urge the same upwardly against the numbering machine 80 at given intervals. Preferably, this cam-actuating device 174 is provided with adjusting means 175 of an already known type, to allow easy and fast adjustment of the pressure under which the roller 71 is urged against the numbering machine 80.

The main function of the lever 160 is to actuate the eccentric system of the impression roller 71 via the link 172 and cam-actuating device 174, at a time synchronized with the passage of each sheet 8 of printed material between the roller 71 and the numbering machine 80. To perform this function, the lever 160 is urged against a main cam 170 fixed onto the shaft 72 on which is mounted the numbering machine 80, by means of a spring 171 fixed to the pin 167 extending the end 164 of the lever. In order to improve the oscillating movement of the lever 160, the cam 170 acts onto the lever 160 through a roller 168 which is located between the pivot 163 and the end 164 of the lever and positioned in cooperative relationship with the cam for this purpose.

At each rotation of the numbering machine 80, the lever 160 is moved downwardly by the cam 170 and upwardly by the spring 171 is an oscillatory movement about the pivot 163, and thus it moves down and up the roller 71.

In addition to the above indicated main function, the lever 160 has a secondary function which is to actuate a blocking lever 142 which is mounted on a central pivot 143 and extends under the pivot 163 in a direction substantially parallel to that of the lever 160, when the blocking arm 138 is engaged below the abutment 169.

The utility of the blocking lever 142 is to firmly hold and retain the lower end of the stop lever 184 on which is mounted the stop 82 when the latter is pulled in operative position by the solenoid 132. In order to do so, the blocking lever 142 is connected to the main lever 160 by means of a link 144 fixed by its lower end to a pin 141 integrally extending the end of the blocking lever 142, which is opposite to the stop lever 184. The upper end of the link 144 is provided with a longitudinal slot 166 in which engages a pin 165 fixed to the lever 160 between the roller 168 and the pin 167. The blocking lever is also connected to a pull-back spring 153 fixed to the pin 41 in a direction opposite to that of the link 144.

As can be seen in companying FIGS. 1 to 4 of the drawings, the blocking lever 142 is moved upwardly by the lever 160 when the latter is moved upwardly by the spring 171, and downwardly by the spring 153 when the cam 170 engages the roller 168. This gives the blocking lever 142 an oscillary movement about its pivot 143, which movement is automatically stopped when the solenoid 132 is actuated. Indeed, in this particular case, the blocking arm 138 limits the amplitude of oscillation of the main lever 160 which is kept on moving with respect to the link 144 as the pin 165 may freely move within the longitudinal slot 166 when the cam 170 rotates, but which does not oscillate enough to raise the same link 144 upwardly.

In order to provide a better engagement of the blocking lever 142 under the lower end of the stop lever 184 to firmly hold the same, the blocking end of the blocking lever 142 is provided with a recessed step 145 (completely shown in dotted lines on FIG. 4), which comes into contact with the pin 187 mounted at the lower end of the lever 184 when the rod 133 is pulled by the solenoid 132.

In order to complete the blocking function of the blocking lever 142, another blocking lever 192 is provided for firmly holding and retaining the upper end of the stop lever 184 when the latter is pulled in operative position. The other blocking lever 192 is mounted on a pivot 191 located at one end thereof, and is positioned in such a manner that it extends just above the shaft 72 in a direction parallel to that of the lever 160.

A secondary cam 190 mounted onto the shaft 72 in a coaxial position, but at an angle of about 120°, with respect to the main cam 170, moves the blocking lever 192 up and down at each rotation of the shaft 72. In order to give an oscillating movement of the blocking lever 192, a spring 193 fixed onto a pin 194, urges the lever 192 downwardly against the cam 190 which acts onto the lever 192 via a roller 198 mounted thereon between the pivot 191 and the pin 194.

At each rotation of the numbering machine 80, the blocking lever 192 is moved upwardly by the cam 190 and downwardly by the spring 195 in an oscillary movement which is in advance of 120° with respect to the oscillary movement of the main lever 160.

The oscillary movement given to the lever 192 allows the stop lever 186 to be blocked in inoperative or operative position and subsequently released from either the inoperative or the operative position at each rotation of the cam 190. To block the stop lever 184 in inoperative position, the lever 192 is positioned in such a manner that its free end 195 which is recessed to form a step 196, blocks the upper end 186 of the stop lever 184. Accordingly, one can see that when the solenoid 132 is actuated, the stop lever 184 can rotate about its pivot 185 only when the cam 190 raises the lever 192 upwardly. To block the stop lever 184 in operative position, the lever 192 is provided with a recessed step 197 located substantially between the spring 193 and its free end 195. This recessed step 197 is positioned in such a manner that the upper end 186 of the stop lever 184 engages therein after the lever 192 has been raised by the cam 190 and the stop lever has been tilted about its pivot 185 by the solenoid 132. Of course, the upper end of the stop lever 184 is automatically released each time the cam 190 raises the blocking lever 192 upwardly, as can clearly by seen in FIG. 4.

To help the above described blocking operation to be performed, a pin provided with a large circular head 188 can be mounted onto to the stop lever 184 at the upper end thereof as shown in the drawings, in order to facilitate engagement of the upper end of the stop lever 184 in both steps 196 and 197.

In FIGS. 1 to 4 of the drawings, the illustrated inking device mechanism is of the manually operated type. This mechanism comprises a lever 150 mounted on a pivot 152, which acts onto an arm 146 which is fixed to the cam 92, to operate the same. This operation moves the inking device 90 forward in tangential contact with the printing wheels of the numbering machine 80 that can then be inked whenever desired or necessary. Of course, an automatically operated mechanism such as that disclosed in U.S. Pat. No. 4,068,582 could also be used in the same satisfactory manner, if wanted.

In FIGS. 1 to 4 of the drawings, the shaft 63 on which is mounted the roller 61 used in combination with the pad 66 fixed onto the shaft 60 to push and optionally perforate the sheet of printed material 8 entering the numbering assembly, is also advantageously provided with adjusting means 176 of an already know type, to allow easy and fast adjustment of the pressure under which the roller 61 is urged against the pad 66 or the equivalent perforating assembly.

If desired, the roller 61 may further be provided with a conventional cam mechanism (not shown) to improve its work against the pad 66 or, more especially, the perforating assembly assembly used instead of the pad.

In operation, when printed material is normally supplied in the offset printing machine and the main switch 120 is on ON, the first electrical circuit is permanently switched on by the detection device 122. At each rotation of the pushing arm 60 mounted on the shaft 62, the cam 130 operates the relay 128 via the switch 124, which in turn switches on the second electrical circuit for a predetermined period of time substantially corresponding to the duration of one rotation of the shaft 62. In the meantime, the cam 130 immediately operates the solenoid 132 which is subsequently kept in actuated position by the second electrical circuit until the rotation of the shaft 62 is completed again.

It should be noted that the second electrical circuit is switched off at each rotation of the shaft 62 by the cam 230 which acts on the normally closed switch 224 but it is immediately after switched on again by the cam 130 which is wider than the cam 230 and therefore can act for a longer period of time upon switch 124 than cam 230 upon switch 224.

As soon as the solenoid 132 is operated and kept in actuated position for the duration of at least one complete rotation of the shaft 62, it pulls and holds in position the rod 133 which in turn pulls back both the blocking arm 138 and the stop lever 184. However, the former cannot fully rotate about its pivot 139 to engage below the abutment 169 until the cam 170 which is positioned at an angle of 180° with respect to the cams 130 and 230, raises the end 162 of the lever 160 upwardly, while the latter cannot be tilted in operative position about its pivot 185 until the cam 190 which is positioned at an angle of 120° with respect to the cam 170 raises, the blocking lever 192 upwardly.

These operational delays which are created by the above described positions of the cams 130, 170 and 190 and mechanically allowed by the slack-giving lamella 140 and spring 191, advantageously permits that the first sheet of printed material coming from the printing machine be printed by the numbering machine 80 before the numbering wheels thereof are advanced by the stop 82 acting on the pawl 81. Indeed, these delays allow the stop 82 to be tilted in the path of the pawl 81 and to act on the same to change the number to be printed only after the numbering machine has rotated of 300° and thus performed its printing operation.

This characteristic is of a very particular interest since it avoids having to reset the numbering wheels each time the printing operations are stopped and restarted.

As soon as the stop lever 184 is tilted in operative position and the blocking arm 138 engages below the abutment 169 and thus limits the oscillating movement of the main lever 160, the blocking lowers 192 and 142 both engage, and firmly maintain, the upper and lower ends of the stop lever 184 in their recessed steps 197 and 145 respectively. In this regard, it should be noted that, contrary to the blocking lever 142 which permanently engages and blocks the lower end of the stop lever 184 as long as the blocking arm is engaged below the main lever 160, that is as long as the solenoid is actuated, the blocking lever 192 automatically releases the upper end of the stop lever 184 each time the cam 190 acts on its roller 198 and raises it upwardly.

Of course, simultaneously to all the above described operations, the main lever 160 which is kept on moving up and, down every time the cam 170 rotates owing to the suitable structure, arrangement and fixation of the link 144 connected the blocking lever 142, and operates the cam actuating device 174 of the impression roller 71 in an oscillary movement synchronized with the passage of the numbering machine 80 in front of it.

As long as printed material is fed into the numbering assembly and operates the detection device 122, the solenoid is kept actuated and the stop 182 is held and firmly retained by the blocking levers in operative position in the path of the pawl 81 so as to continuously advance the numbering wheels.

As soon as a sheet 8 of printed material is missing, the detection device 122 opens the first electrical circuit. Then, the relay 128 being not reactuated when the cam 130 passes in front of the switch 124, the second electrical circuit is opened as soon as the cam 230 act on the switch 224, that is after one further rotation of the shaft 62, and the solenoid 132 is completely deactuated. The utility of such an additional rotation allowed by the relay 128 and cam 230, is to give enough time to the numbering machine to print the last sheet of printed material supplied by the offset press.

Although the solenoid 132 is then completely deactuated, the stop lever 184 is still kept in operative position for another additional half-rotation by the blocking lever 142 which is kept is blocking position by its spring 153 until the cam 170 acts on the lever 160 to raise the same and as a result thereof to release the blocking arm 138 which may disengage from the abutment 169.

Even when this additional half-rotation has been completed and the blocking arm 142 has been reactuated by the lever 160 to release the lower end of the stop lever 184, the latter is kept yet in operative position of a further additional rotation of 120° until the cam 190 raises the blocking lever 192 and allows the upper end of the stop lever 184 to be completely disengaged. The stop lever 184 can then be moved back in nonoperative position by the built-in, pull-back spring of the solenoid 132 (not shown).

This additional rotation of 300° allowed by the cams 170 and 190, advantageously keeps the stop 82 in operative position in the path of the pawl 81 to actuate the same one more time before stopping the numbering operation, so that the numbering wheels be ready to print the consecutive number as soon as printed material is supplied again.

As can therefore be understood, the stop 82 which cams pawl 81 and consequently steps the numbering machine 80 at each rotation of its shaft 72, is thus moved upwardly in an inoperative position with a certain delay as soon as the absence of a sheet 8 of printed material has been detected so that the last sheet of printed material passing in front of the detecting device 122 can however be printed when arriving in the numbering assembly and the numbering machine can be advanced in view of its next operation.

As soon as printed material is supplied again in the off-set printing machine, the detection device 122 is again operated and the numbering operation is started again as it has been previously described.

Of course, the whole numbering operation can be selectively stopped when required or desired by means of the main switch 120 which directly switches off the first and second electrical circuits.

The embodiments of the invention in which an exclusive property or privilege is claimed are defined as follows:

1. In an offset press comprising:

(a) a printing machine;

(b) a delivery machine cooperatively arranged relative to the printing machine for receiving the printed material discharged therefrom and delivering it to a point of deposit, said delivery machine including driving means and picking-up devices associated to said driving means for gripping the material discharged from the printing machine; and (c) a numbering assembly comprising;

a numbering machine cooperatively arranged on a shaft relative to the delivery machine to serially number the printed material passing therethrough, said numbering machine including printing wheels having serial numbers thereon, a pawl for selectively stepping wheels each time a number is to be impressed upon a sheet of printed material and a stop for actuating said pawl at each passage of a sheet of printed material, an impression roller positioned beneath the numbering machine in cooperative relationship therewith; and a control assembly for instantaneously deactuating the numbering machine upon stopping of the press or in the absence of printed material to be numbered to avoid the printing wheels from being inadvertantly stepped several units forward, and for automatically reactuating the same when printed material is supplied again, the improvement wherein said control assembly comprises:

(a) a first electrical circuit comprising a detection device responsive to the presence and absence of gripped material into the delivery machine, a first, normally open switch, and a solenoid all connected in series, said first circuit also comprising a relay mounted in parallel to the solenoid, said detection device closing said first circuit when printed material is normally supplied and opening the same when printed material is missing, said first switch closing the first circuit for a short period of time at each rotation of the shaft on which is mounted the numbering machine, said relay closing a second electrical circuit for a predetermined period of time each time it receives an electric impulsion from the first switch, said first switch also actuating the solenoid which in turn actuates mechanical means which brings the stop of the numbering machine in operative position into the path of the pawl so that the number to be printed, be stepped each time a sheet of printed material passes through the numbering machine;

(b) said second electrical circuit comprising a second, normally closed switch, the above mentioned relay and the above mentioned solenoid, said relay when actuated, closing the second electrical circuit for a predetermined period of time which corresponds to the time necessary for the shaft to complete a rotation and to close again the first switch of the first circuit, said second electrical circuit being therefore closed and the solenoid kept in actuating position during said predetermined period of time, (c) said mechanical means actuated by the solenoid comprising:

a main lever mounted on a central pivot and permanently provided with an oscillary movement generated by a main cam mounted on the numbering machine shaft;

a stop lever operated by the solenoid and supporting on its axis the stop used for camming the pawl of the numbering machine;

blocking means operated by the solenoid for limiting the amplitude of the oscillations of the main lever, and first and second blocking levers for holding both ends of the stop lever on which is mounted the stop when the latter is in operative position, said first blocking lever being permanently provided with an oscillary movement generated by another cam mounted on the numbering machine shaft at an angle with respect to the main cam, to give the above mentioned delay to the stop before being moved out of the path of the pawl, said second blocking lever being connected to the main lever and actuated by said main lever when the oscillations of this main lever are not limited by the blocking means, whereby, as long either the first or second electrical circuits are closed, the solenoid is actuated and causes both the stop lever to be tilted about its axis and to hold the stop in operative position and the blocking means to limit the oscillations of the main lever, said tilting of the stop lever being delayed when the circuits are closed, by the first blocking lever which releases the stop lever only when the other cam moves the first blocking lever up, and second blocking lever being positioned inside the machine in such a manner that it may engage the stop lever when the same is tilted in operative position and hold it in this position even when the first blocking lever is released by the other cam at each rotation of the machine shaft.

2. An offset press as claimed in claim 1, wherein the main cam is positioned so as to operate the main lever half a rotation after the first and second switch have been operated, and the other cam is positioned at an angle of 120° with respect to the main cam, such positioning allowing the stop to be tilted in the path of the pawl only after the numbering machine has printed the first sheet of printed material to be supplied, and said stop to be kept in operative position in the path of the pawl to actuate it one more time before stopping the numbering operation so that the numbering wheels are ready to print a consecutive number as soon as printed material is supplied again.

3. An offset press as claimed in claim 2, wherein the first an second blocking lever extend substantially parallel to the main lever and the stop lever extends perpendicular thereto.

4. An offset press as claimed in claim 3, wherein the impression roller is connected to the main lever and operated by the main cam.

5. An offset press as claimed in claim 4, further comprising an inking device for inking the numbering machine.

6. An offset press as claimed in claim 5, further comprising a perforating machine mounted in cooperative relationship with the numbering machine to perforate the printed material passing through said numbering machine.

* * * * *